US007212222B2

(12) United States Patent
Yamakawa

(10) Patent No.: US 7,212,222 B2
(45) Date of Patent: May 1, 2007

(54) THERMAL HEAD AND THERMAL PRINTER

(75) Inventor: Kenji Yamakawa, Saitama (JP)

(73) Assignee: Fujifilm Corporation, Tokyo (JP)

( * ) Notice: Subject to any disclaimer, the term of this patent is extended or adjusted under 35 U.S.C. 154(b) by 247 days.

(21) Appl. No.: 11/073,520

(22) Filed: Mar. 8, 2005

(65) Prior Publication Data

US 2005/0200691 A1 Sep. 15, 2005

(30) Foreign Application Priority Data

Mar. 9, 2004 (JP) ..... 2004-065931

(51) Int. Cl.
*B41J 2/335* (2006.01)

(52) U.S. Cl. ..... 347/204

(58) Field of Classification Search ..... 347/200, 347/202, 204, 205, 206, 208
See application file for complete search history.

(56) References Cited

U.S. PATENT DOCUMENTS 6,683,636 B2 * 1/2004 Goto et al. ..... 347/171
7,046,265 B2 * 5/2006 Shirakawa et al. ..... 347/202
2004/0233268 A1 * 11/2004 Miyachi et al. ..... 347/200

FOREIGN PATENT DOCUMENTS

JP 10-138543 A 5/1998
JP 10-278329 A 10/1998

* cited by examiner

*Primary Examiner*—K. Feggins
(74) *Attorney, Agent, or Firm*—Sughrue Mion, PLLC

(57) ABSTRACT

A heating element of a thermal head has a first electrode layer formed on a glaze layer and a second electrode layer formed opposite to the first electrode layer. A first insulation layer is formed on the first electrode layer to expose both ends of the first electrode layer in a transporting direction of a recording paper. A third electrode layer is formed on the first insulation layer to expose both ends of the first insulation layer in the transporting direction, and a heating resistor layer is formed across the first to the third electrode layers and the first insulation layer. A protective layer is formed covering the first to the third electrode layers, the first insulation layer, and the heating resistor layer. A system controller selectively applies the current to among the first, the second and the third electrode layers based on the image data to record.

10 Claims, 5 Drawing Sheets

THERMAL HEAD AND THERMAL PRINTER

BACKGROUND OF THE INVENTION

1. Field of the Invention

The present invention relates to a thermal head having a heating element array with a line of a plurality of heating elements, and a thermal printer having the thermal head.

2. Background Arts

A thermal printer is known to record images on a recording paper by using a thermal head having a line of a plurality of heating elements (resistors). As the thermal printers, there are a color direct thermal printer that develops colors by directly heating a thermosensitive recording paper by means of the heating elements, and a thermal transfer printer that transfers the ink of the ink ribbon to the recording paper by putting the ink ribbon on the recording paper and heating the rear face of the ink ribbon by means of the heating elements.

Japanese Patent Laid-Open Publication Number H10-138543 discloses a thermal head that has the heating elements comprising first heating resistors disposed at the upstream side of a transportation path of the recording paper and second heating resistors disposed at the downstream side of the first heating resistors. The first heating resistors supply the recording paper with a minimum energy necessary to develop color, while the second heating resistors supply the recording paper with the energy to develop color at predetermined gradations. This thermal head is capable of reducing the driving electrical current to be supplied to the second heating resistors.

Another thermal head is capable of extending the lives of the heating elements by having the first heating resistors and the second heating resistors, which are disposed at a predetermined distance from the first heating resistors in the transporting direction of the recording paper, and using them alternately (for example, disclosed in Japanese Patent Laid-Open Publication Number H10-278329). One of the methods for recording fine lines and minute dots with the above thermal heads is to partially heat the recording paper by using the heating elements shortened in the transporting direction of the recording paper. However, the thermal head, disclosed in Japanese Patent Laid-Open Publication Number H10-138543, is not capable of recording fine lines and minute dots, regardless of that the first and the second heating resistors have different lengths. This is because this thermal head performs color developing twice, first with the first heating resistors then with the second heating resistors. The thermal head disclosed in Japanese Patent Laid-Open Publication Number H10-278329 may extend the lives of the heating elements, but it is not capable of recording fine lines and minute dots either, for having the heating elements of the same length.

Although the thermal head disclosed in Japanese Patent Laid-Open Publication Number H10-138543 is possibly capable of recording fine lines and minute dots by selectively heating the first heating resistors that is shorter than the second heating resistors, it needs to have electrode layers threading between the first and the second heating resistors. This results not only in complicating the constitution of the thermal head that leads to increase the manufacturing cost, but also in inhibiting the downsizing of the thermal head because the adjacent heating elements need to be spaced to each other.

SUMMARY OF THE INVENTION

An object of the present invention is to provide a thermal head and a thermal printer with the simple constitution that are capable of recording fine lines and minute dots as well as regular images.

In order to achieve the above object and other objects, a heating element in the thermal head of the present invention comprises a first electrode layer formed on an insulation substrate, a second electrode layer formed in the position opposite to the first electrode layer, a first insulation layer formed on the first electrode layer to expose both ends of the first electrode layer in the transporting direction of a recording material, a third electrode layer formed on the first insulation layer to expose both ends of the first insulation layer in the transporting direction, a heating resistor layer formed across the first to the third electrode layers and the first insulation layer, and at least one protective layer covering all of those layers.

In addition, the thermal printer of the present invention is provided with the thermal head having the first, the second, the third and a fourth electrode layers, and a controller for selectively supplying the electricity to among the first to the third electrode layers or among the first to fourth electrode layers based on the image data to record.

According to the present invention, it is possible to record fine lines and minute dots by the thermal head with the simple constitution. Thereby, it provides a print of higher quality and resolution. Furthermore, it is not necessary to extend the thermal head in the width direction of the recording paper, since it is possible to arrange the heating elements without widely spacing because the second electrode layer forms a common electrode, whereas the first and the third electrode layer form discrete electrodes.

BRIEF DESCRIPTION OF THE DRAWINGS

One with ordinary skill in the art would easily understand the above-described objects and advantages of the present invention when the following detailed description is read with reference to the drawings attached hereto.

PREFERRED EMBODIMENTS OF THE INVENTION

Figure 1:
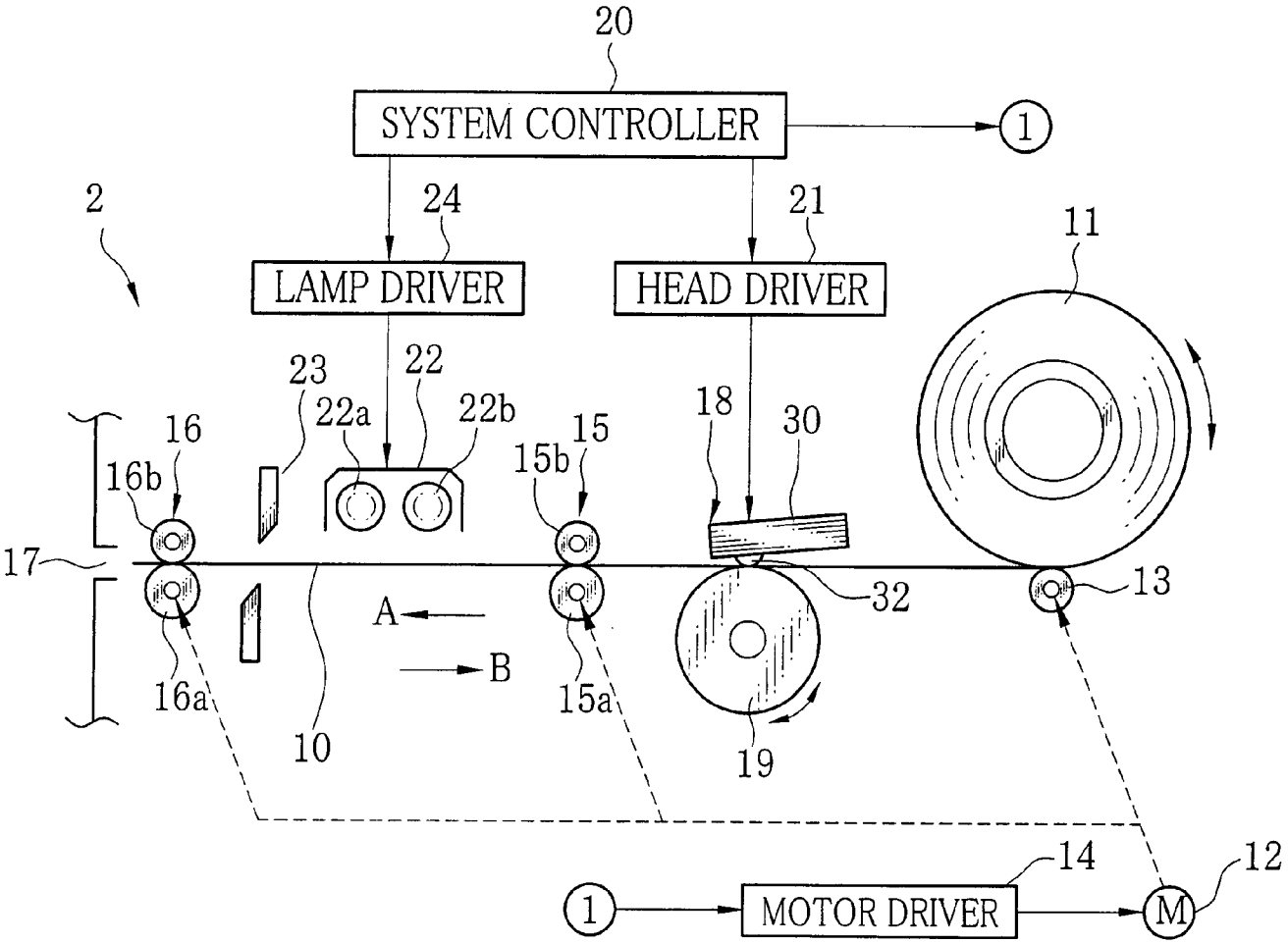
FIG. 1 is a schematic view illustrating the constitution of a color thermal printer of the present invention.

As shown in FIG. 1, a color direct thermal printer 2 of the present invention uses a continuous color thermosensitive recording paper (hereinafter abbreviated as recording paper) 10 as a recording material. The recording paper 10 is rolled into a recording paper roll 11 and set in the color direct thermal printer 2.

The recording paper 10 comprises a support, a cyan thermosensitive coloring layer, a magenta thermosensitive coloring layer, a yellow thermosensitive coloring layer, and a protective layer, stacking in the stated order. The yellow thermosensitive coloring layer formed on top of the other two coloring layers is the most thermosensitive among the three thermosensitive coloring layers and develops yellow color with low thermal energy. The cyan thermosensitive coloring layer formed under the other two coloring layers is the least thermosensitive among the three thermosensitive coloring layers and needs high thermal energy to develop cyan color.

The yellow thermosensitive coloring layer loses its ability to develop yellow color when exposed to near ultraviolet rays of 420 nm. The magenta thermosensitive coloring layer develops magenta color by thermal energy with a level between the one to develop yellow color in the yellow thermosensitive coloring layer and the other to develop cyan color in the cyan thermosensitive coloring layer, and loses its ability to develop magenta color when exposed to ultraviolet rays of 365 nm. Note that it is also possible to use a recording paper comprising four thermosensitive coloring layers formed of the above three color thermosensitive coloring layers and a black thermosensitive coloring layer.

A feed roller 13, rotated by a transport motor 12, contacts with the periphery of the recording paper roll 11. The transport motor 12 is a stepping motor driven by a driving pulse from a motor driver 14. When the feed roller 13 rotates counterclockwise, the recording paper roll 11 is rotated clockwise by the feed roller 13 and the recording paper 10 is drawn from the recording paper roll 11. When the feed roller 13 rotates clockwise, the recording paper roll 11 is rotated counterclockwise by the feed roller 13 and the recording paper 10 is rewound to the recording paper roll 11.

The recording paper 11 drawn out from the recording paper roll 11 is fed into a horizontal transportation path. In the transportation path, a transport roller pair 15 and a discharge roller pair 16 are disposed to nip and transport the recording paper 10. The transport roller pair 15 comprises a capstan roller 15*a* and a pinch roller 15*b* pressed against the capstan roller 15*a*, and the discharge roller pair 16 comprises a capstan roller 16*a* and a pinch roller 16*b* pressed against the capstan roller 16*a*. Each transport roller pair 15 and discharge roller pair 16 is rotated by the transport motor 12 to reciprocate the recording paper 10 both in the transporting direction A and in the rewinding direction B. A discharge opening 17 is disposed at the downstream side of the discharge roller pair 16 to discharge the recorded recording paper 10.

A thermal head 18 and a platen roller 19, which is disposed opposite to the thermal head 18 across the transportation path, are disposed between the feed roller 13 and the transport roller pair 15. The surface of a head substrate 30 of the thermal head 18 facing to the recording paper 10 is provided with a heating element array 32 with a line of a plurality of heating elements 31 (see FIG. 2 and FIG. 3).

The platen roller 19 rotates in response to the transportation of the recording paper 10 and firmly puts the recording paper 10 on the heating element array 32. The platen roller 19 is movable upward and downward and biased by a spring (not shown) in the direction to the heating element array 32. The platen roller 19 is operated to descend by a shift mechanism (not shown) comprising a cam and a solenoid, to stop nipping the recording paper 10 with the thermal head 18.

An optical fixer 22 is disposed facing the recording area of the recording sheet 10 at the downstream side of the transport roller pair 15. A cutter 23 is provided between the optical fixer 22 and the discharge roller pair 16 to cut the recording paper into a sheet of a predetermined print size. The optical fixer 22 comprises a yellow-fixing light source 22*a* for fixing the yellow thermosensitive coloring layer by radiating near ultraviolet rays having an emission peak at 420 nm, and a magenta-fixing light source 22*b* for fixing the magenta thermosensitive coloring layer by radiating ultraviolet rays having the emission peak at 365 nm. Both light sources 22*a* and 22*b* are driven by a lamp driver 24.

The following is an explanation of an operation of the color direct thermal printer 2 having the above constitution. When an operation to start image recording is performed, the feed roller 13 is rotated counterclockwise by the rotation of the transport motor 12 and draws out the recording paper 10 from the recording paper roll 11 to feed it in the A direction. The front end of the recording paper 10 is nipped by the transport roller pair 15 after transported through the transportation path, and transported further to downstream side in the A direction.

When the recording paper 10 reaches a start position for image recording, the transport motor 12 is stopped rotating temporarily. Subsequently, the platen roller 19 is shifted upward by the shift mechanism to nip the recording paper 10 with the heating element array 32. In this state, the transport motor 12 is driven again to transport the recording paper 10 in the A direction, and a yellow image is recorded on the yellow thermosensitive coloring layer of the recording paper 10 by the heating element array 32, which is heated based on the driving data input to the head driver 21.

After the record of the yellow image, the recording paper 10 is transported until the rear end of the recorded image faces the yellow-fixing light source 22*a* of the optical fixer 22, and then the transport motor 12 is stopped rotating. At this point the platen roller 19 is shifted downward by the shift mechanism to release the nip of the recording paper 10 with the thermal head 18. Subsequently, the yellow-fixing light source 22*a* is lit up by the lamp driver 24 and optically fixes the recorded yellow thermosensitive coloring layer while the transport motor 12 counterrotates rewinding the recording paper 10 in the B direction.

After the optical fixation of the yellow thermosensitive coloring layer, the recording paper 10 is transported until the front end of the recorded image faces the heating element array 32, and then the transport motor 12 is stopped rotating. At this point the platen roller 19 is shifted upward by the shift mechanism in the same way as the record of the yellow image to nip the recording paper 10 with the heating element array 32. In this state, the transport motor 12 is driven again to transport the recording paper 10 in the A direction, and a magenta image is recorded on the magenta thermosensitive coloring layer of the recording paper 10.

After the record of the magenta image, the recording paper 10 is transported until the rear end of the recorded image faces the magenta-fixing light source 22*b* of the optical fixer 22, and then the transport motor 12 is stopped rotating. Subsequently, the magenta-fixing light source 22*b* is lit up by the lamp driver 24 in the same way as the fixation of the yellow image and optically fixes the recorded magenta thermosensitive coloring layer while the transport motor 12 counterrotates rewinding the recording paper 10 in the B direction.

After the optical fixation of the magenta thermosensitive coloring layer, the recording paper 10 is transported until the front end of the recorded image faces the heating element array 32, and then the transport motor 12 is stopped rotating. Subsequently, a cyan image is recorded on the cyan thermosensitive coloring layer of the recording paper 10 in the same way as the record of the yellow and the magenta images.

Figure 2:
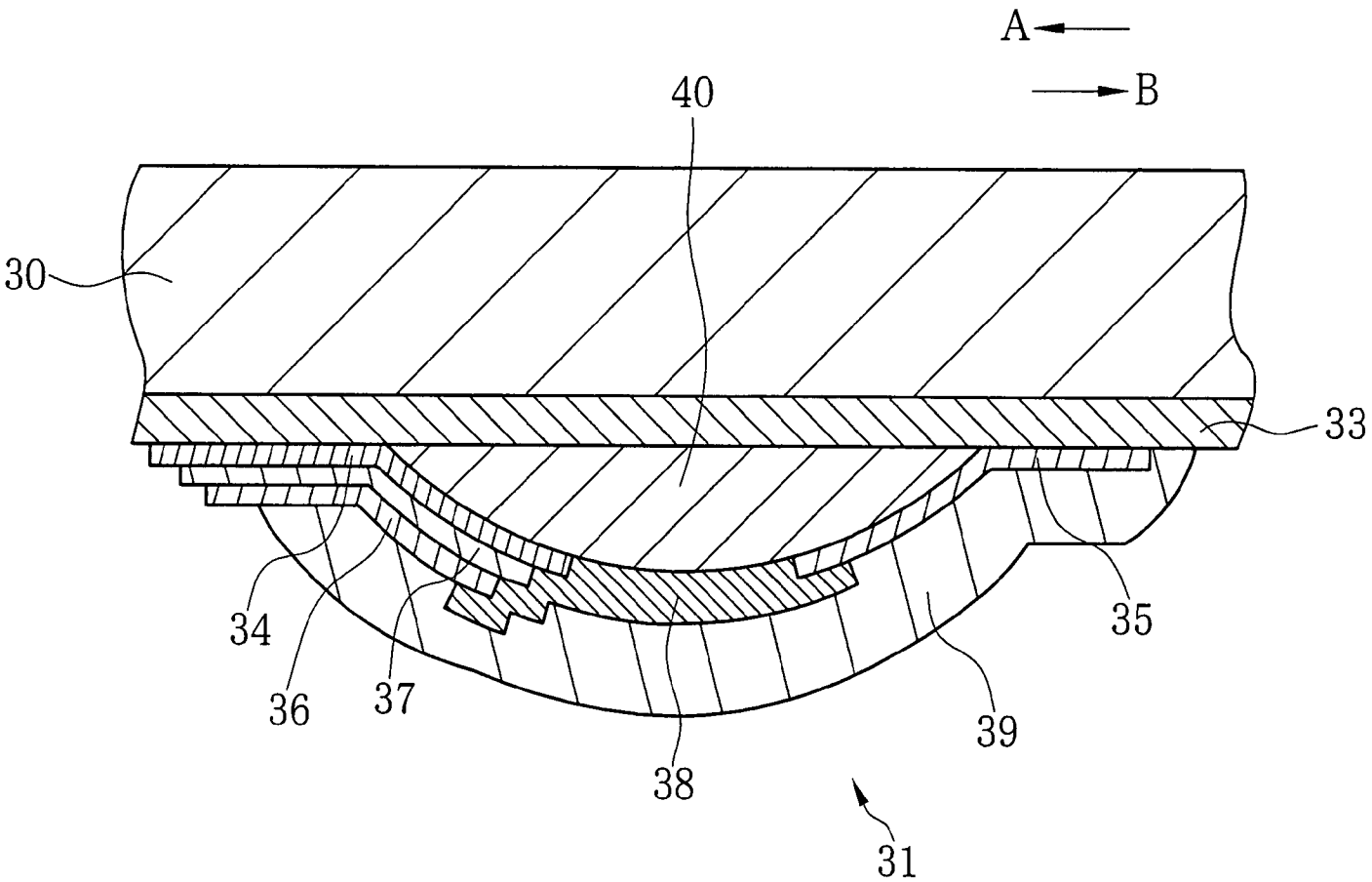
FIG. 2 is a cross sectional view illustrating the schematic constitution of a heating element.
Figure 3:
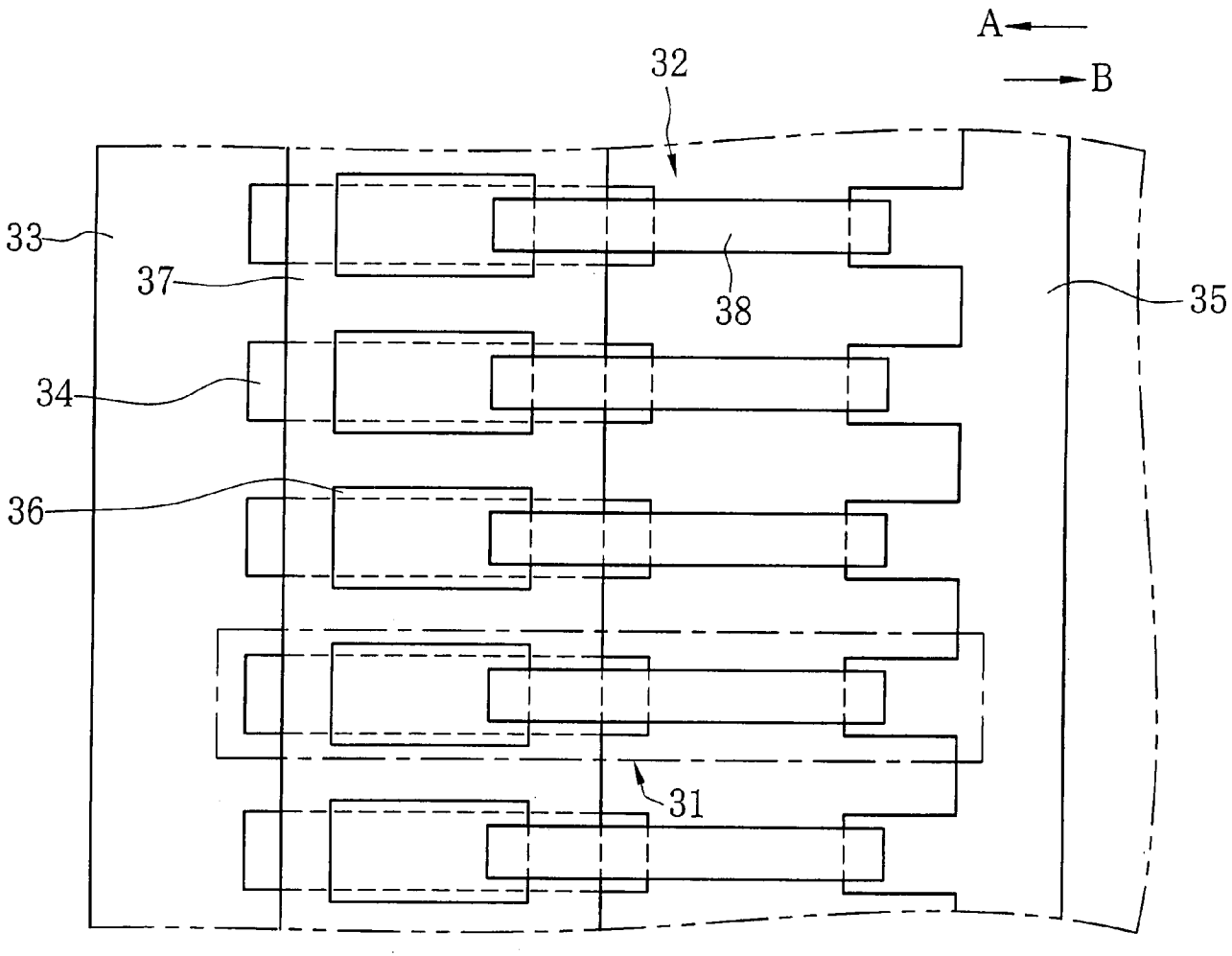
FIG. 3 is a plane view illustrating the schematic constitution of the heating element.
Figure 4:
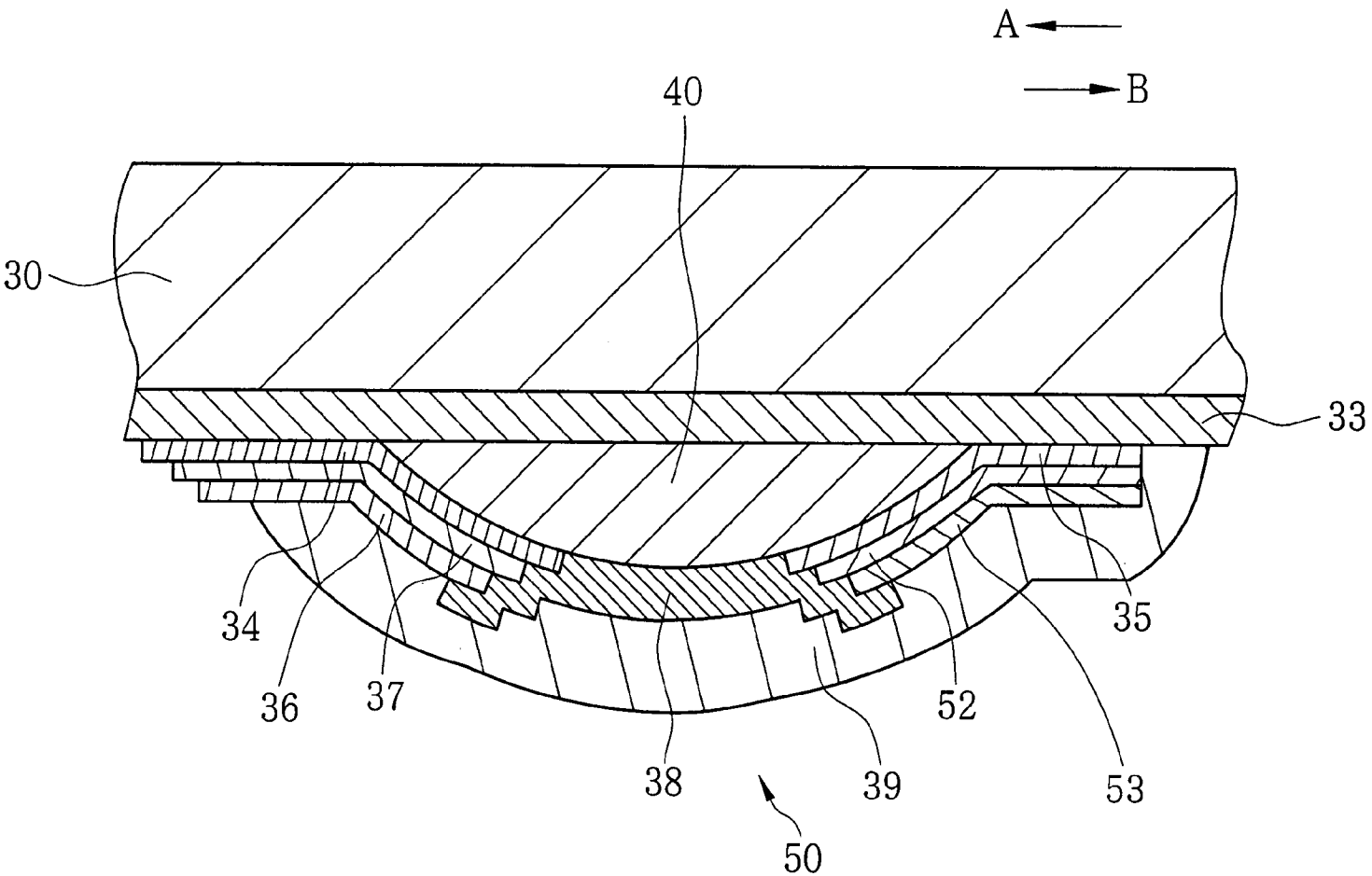
FIG. 4 is a cross sectional view illustrating the schematic constitution of the heating element in another embodiment of the present invention.
Figure 5:
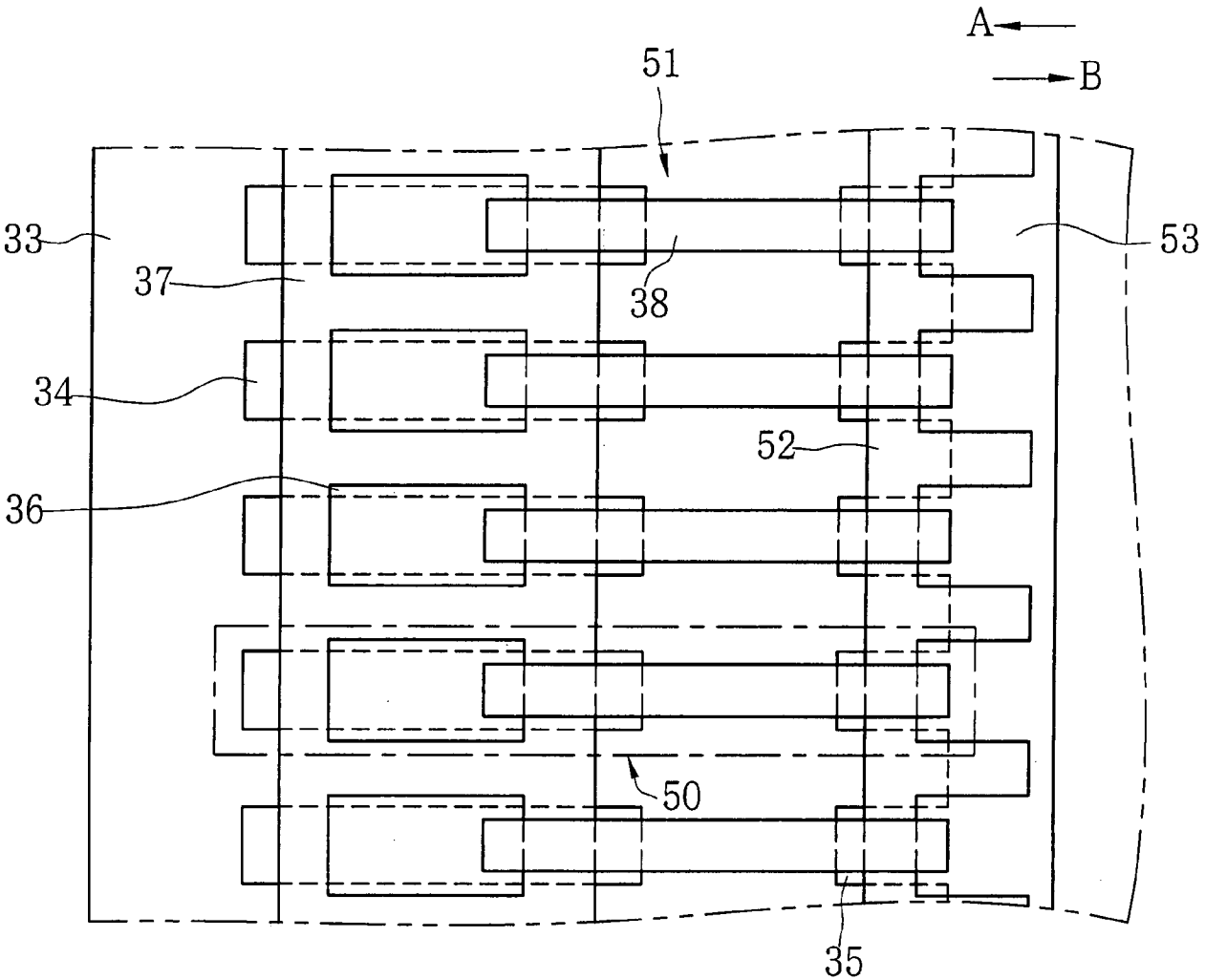
FIG. 5 is a plane view illustrating the schematic constitution of the heating element shown in FIG. 4.

Then, the recording paper 10 is transported in the A direction by the transport roller pair 15, and discharged by the discharge roller pair 16 out of the color direct thermal printer 2 via the paper discharge opening 17 after cut into a sheet of the predetermined print size by the cutter As shown in FIG. 2 and FIG. 3, a glaze layer 33 formed of glazed glass, the heating element 31 comprising a first to a third electrode layers 34 to 36, a first insulation layer 37, a heating resistor layer 38, and a protective layer 39 are stacked upon the head substrate 30. A partial glaze 40 is formed to cylindrically protrude in a part of the glaze layer 33. The partial glaze 40 extends in the width direction of the recording paper 10. To avoid complication, the protective layer 39 is not shown in FIG. 3.

The first electrode layer 34 and the second electrode layer 35 are disposed opposite to each other along the transporting direction of the recording paper 10. The first insulation layer 37 is formed on the first electrode layer 34 to expose both ends of the first electrode layer 34 in the transporting direction. The third electrode layer 36 is formed on the first insulation layer 37 to expose both ends of the first insulation layer 37 in the transporting direction. The heating resistor layer 38 is formed across the first to the third electrode layers 34 to 36 and the first insulation layer 37. The protective layer 39 is formed to cover all of those layers except one end of each of the first electrode layer 34, the third electrode layer 36, and the first insulation layer 37. Note that the protective layer 39 can be multilayered.

Each of the first, the second and the third electrode layers 34, 35 and 36 is connected to a print board (not shown) having a driver IC mounted thereon for controlling the current applied to the heating element 31. The second electrode layer 35 forms a common electrode, while the first and the third electrode layers 34 and 36 respectively form discrete electrodes. A lead line (not shown) is connected to the ends of the first and the third electrode layers 34 and 36, which are not covered with the protective layer 39. Each of the heating elements 31 is selectively driven by the driver IC.

The heating element array 32 is heated based on the driving data input to the head driver 21 from the system controller 20 to develop colors on each thermosensitive layer of the recording paper 10. Based on the image data to record, the system controller 20 selectively applies the current to among the first, the second, and the third electrode layers 34, 35 and 36. In particular, the system controller 20 selects the third electrode layer 36 to heat the heating resistor layer 38 between the third electrode layer 36 and the second electrode layer 35 in order to record a regular image, while it selects the first electrode layer 34 to heat the heating resistor layer 38 between the first electrode layer 34 and the second electrode layer 35 in order to record fine lines and minute dots. Thereby, the length of the heating element 31 in the transporting direction of the recording paper 10 becomes shorter than that in the regular image recording. That is, the heating element 31 is capable of recording fine lines and minute dots on the recording paper 10, since a pixel is shortened in a sub-scanning direction in comparison with that to record the regular image.

Note that it is also possible to form a second insulation layer 52 on the second electrode layer 35 to expose one end of the second electrode layer 35 in the transporting direction of the recording paper 10 and to form simultaneously a fourth electrode layer 53 on the second insulation layer 52 to expose one end of the second insulation layer 52 in the transporting direction. In this case, the second and the fourth electrode layers 35 and 53 form common electrodes, and the heating resistor layer 38 is heated when the current is supplied to the combination of the first electrode layer 34 and the fourth electrode layer 53 or the combination of the third electrode layer 36 and the fourth electrode layer 53, in addition to the combination of the first electrode layer 34 and the second electrode layer 35 or the combination of the second electrode layer 35 and the third electrode layer 36. Thereby the length of the heating element 50 is more gradually changed in the transporting direction of the recording paper 10, which enables to record the image of higher resolution based on the image data to record.

Note that the heating element with a plane glaze is also applicable to the present invention instead of the heating elements 31 and 50 with the partial glaze 40 in the above embodiment. In addition, a one-path system color direct thermal printer, in which yellow, magenta and cyan images are thermally recorded on the recording paper while the recording paper is once passing three thermal heads for each color, is also applicable to the present invention instead of the color direct thermal printer 2 in the above embodiment that is a reciprocating transport print type to thermally record and optically fix yellow, magenta and cyan images by reciprocating the recording paper 10 under a single thermal head 18 and the optical fixer 22 alternately.

Furthermore, the present invention is applicable not only to the color direct thermal printer 2 in the above embodiment by way of example but also to other thermal printers such as a thermal transfer printer and the like.

Although the present invention has been described with respect to the preferred embodiments, the present invention is not to be limited to the above embodiments but, on the contrary, various modifications will be possible to those skilled in the art without departing from the scope of claims appended hereto.

What is claimed is:

1. A thermal head for recording an image on a recording material, said thermal head including a heating element array with a line of a plurality of heating elements, each of said heating element comprising:

a first electrode layer formed on an insulation substrate;

a second electrode layer formed in the position opposite to said first electrode layer;

a first insulation layer formed on said first electrode layer to expose both ends of said first electrode layer in a transporting direction of said recording material;

a third electrode layer formed on said first insulation layer to expose both ends of said first insulation layer in said transporting direction;

a heating resistor layer formed across said first electrode layer, said second electrode layer, said third electrode layer, and said first insulation layer; and at least one protective layer formed covering said first electrode layer, said second electrode layer, said third electrode layer, said first insulation layer, and said heating resistor layer.

2. A thermal head defined in claim 1, wherein said second electrode layer forms a common electrode, while said first electrode layer and said third electrode layer form discrete electrodes.

3. A thermal head defined in claim 2, wherein said heating resistor layer is heated by the current applied to said second electrode layer and said third electrode layer in order to record a regular image, or by the current applied to said second electrode layer and said first electrode layer in order to record fine lines and minute dots.

4. A thermal head for recording an image on a recording material, said thermal head including a heating element array with a line of a plurality of heating elements, each of said heating element comprising:

a first electrode layer formed on an insulation substrate;

a second electrode layer formed in the position opposite to said first electrode layer;

a first insulation layer formed on said first electrode layer to expose both ends of said first electrode layer in a transporting direction of said recording material;

a third electrode layer formed on said first insulation layer to expose both ends of said first insulation layer in said transporting direction;

a second insulation layer formed on said second electrode layer to expose one end of said second electrode layer in said transporting direction;

a fourth electrode layer formed on said second insulation layer to expose one end of said second insulation layer in said transporting direction;

a heating resistor layer formed across said first electrode layer, said second electrode layer, said third electrode layer, said fourth electrode layer, said first insulation layer, and said second insulation layer; and at least one protective layer formed covering said first electrode layer, said second electrode layer, said third electrode layer, said fourth electrode layer, said first insulation layer, said second insulation layer, and said heating resistor layer.

5. A thermal head defined in claim 4, wherein said second electrode layer and said fourth electrode layer forms common electrodes, while said first electrode layer and said third electrode layer form discrete electrodes.

6. A thermal head defined in claim 5, wherein said heating resistor layer is heated by the current applied to said second electrode layer and said third electrode layer in order to record a regular image.

7. A thermal head defined in claim 6, wherein said heating resistor layer is heated by the current applied to said second electrode layer and said first electrode layer in order to record fine lines and minute dots.

8. A thermal head defined in claim 6, wherein said heating resistor layer is heated by the current applied to said fourth electrode layer and said third electrode layer in order to record a pixel larger than that in said regular image.

9. A thermal printer for thermally recording an image on a recording material comprising:

(A) a thermal head including a heating element array with a line of a plurality of heating elements, each of said heating element comprising:

a first electrode layer formed on an insulation substrate;

a second electrode layer formed in the position opposite to said first electrode layer;

a first insulation layer formed on said first electrode layer to expose both ends of said first electrode layer in a transporting direction of said recording material;

a third electrode layer formed on said first insulation layer to expose both ends of said first insulation layer in said transporting direction;

a heating resistor layer formed across said first electrode layer, said second electrode layer, said third electrode layer, and said first insulation layer; and at least one protective layer formed covering said first electrode layer, said second electrode layer, said third electrode layer, said first insulation layer, and said heating resistor layer; and (B) a control device for selectively applying the current to among said first electrode layer, said second electrode layer, and said third electrode layer, based on image data to record.

10. A thermal printer for thermally recording an image on a recording material comprising:

(A) a thermal head including a heating element array with a line of a plurality of heating elements, each of said heating element comprising:

a first electrode layer formed on an insulation substrate;

a second electrode layer formed in the position opposite to said first electrode layer;

a first insulation layer formed on said first electrode layer to expose both ends of said first electrode layer in a transporting direction of said recording material;

a third electrode layer formed on said first insulation layer to expose both ends of said first insulation layer in said transporting direction;

a second insulation layer formed on said second electrode layer to expose one end of said second electrode layer in said transporting direction;

a fourth electrode layer formed on said second insulation layer to expose one end of said second insulation layer in said transporting direction;

a heating resistor layer formed across said first electrode layer, said second electrode layer, said third electrode layer, said fourth electrode layer, said first insulation layer, and said second insulation layer; and at least one protective layer formed covering said first electrode layer, said second electrode layer, said third electrode layer, said fourth electrode layer, said first insulation layer, said second insulation layer, and said heating resistor layer; and (B) a control device for selectively applying the current to among said first electrode layer, said second electrode layer, said third electrode layer, and said fourth electrode layer, based on image data to record.

* * * * *